US006421858B1

(12) United States Patent
Cuérel

(10) Patent No.: US 6,421,858 B1
(45) Date of Patent: Jul. 23, 2002

(54) MATTRESSES OR CUSHIONS

(75) Inventor: Philippe Cuérel, Abtwil (CH)

(73) Assignee: Doc AG, St. Gallen (CH)

( * ) Notice: Subject to any disclaimer, the term of this patent is extended or adjusted under 35 U.S.C. 154(b) by 0 days.

(21) Appl. No.: 09/568,887

(22) Filed: May 11, 2000

(30) Foreign Application Priority Data

Jul. 15, 1999 (CH) ..... 1307/99

(51) Int. Cl.[7] ..... A47C 27/08; A61G 7/057
(52) U.S. Cl. ..... 5/713; 5/710
(58) Field of Search ..... 5/706, 710, 711, 5/712, 713, 654, 655.3, 935

(56) References Cited

U.S. PATENT DOCUMENTS

| | | | | | |
|---|---|---|---|---|---|
| 2,887,692 | A | * | 5/1959 | Gosman | 5/711 X |
| 4,120,061 | A | * | 10/1978 | Clark | 5/710 |
| 4,694,520 | A | * | 9/1987 | Paul et al. | 5/706 |
| 4,711,275 | A | * | 12/1987 | Ford et al. | 5/710 X |
| 4,864,671 | A | * | 9/1989 | Evans | 5/710 X |
| 5,020,176 | A | * | 6/1991 | Dotson | 5/710 |
| 5,044,029 | A | * | 9/1991 | Vrzalik | 5/713 |
| 5,065,466 | A | * | 11/1991 | Thomas et al. | 5/713 |
| 5,182,826 | A | * | 2/1993 | Thomas et al. | 5/713 |
| 5,251,349 | A | * | 10/1993 | Thomas et al. | 5/713 |
| 5,283,735 | A | * | 2/1994 | Gross et al. | 5/935 X |
| 5,487,196 | A | * | 1/1996 | Wilkinson et al. | 5/710 X |
| 5,509,154 | A | * | 4/1996 | Shafer et al. | 5/713 |
| 5,560,057 | A | * | 10/1996 | Madsen et al. | 5/710 X |
| 5,586,346 | A | * | 12/1996 | Stacy et al. | 5/710 |
| 5,606,754 | A | * | 3/1997 | Hand et al. | 5/713 |
| 5,611,096 | A | * | 3/1997 | Bartlett et al. | 5/713 X |
| 5,647,079 | A | * | 7/1997 | Hakamiun et al. | 5/713 |
| 5,652,484 | A | * | 7/1997 | Shafer et al. | 5/713 X |
| 5,794,288 | A | * | 8/1998 | Soltani et al. | 5/713 |
| 5,815,864 | A | * | 10/1998 | Sloop | 5/710 X |
| 5,848,450 | A | * | 12/1998 | Oexman et al. | 5/713 |
| 5,873,137 | A | * | 2/1999 | Yavets-Chen | 5/713 |
| 5,903,941 | A | * | 5/1999 | Shafer et al. | 5/713 X |
| 5,963,997 | A | * | 10/1999 | Hagopian | 5/654 |
| 5,983,429 | A | * | 11/1999 | Stacy et al. | 5/713 |
| 6,014,784 | A | * | 1/2000 | Taylor et al. | 5/713 |
| 6,037,723 | A | * | 3/2000 | Shafer et al. | 5/713 X |
| 6,058,537 | A | * | 5/2000 | Larson | 5/710 |
| 6,098,222 | A | * | 8/2000 | Hand et al. | 5/713 |
| 6,115,860 | A | * | 9/2000 | Vrzalik | 5/713 X |
| 6,178,578 | B1 | * | 1/2001 | Soltani et al. | 5/713 |
| 6,212,718 | B1 | * | 4/2001 | Stolpmann et al. | 5/713 |
| 6,353,950 | B1 | * | 3/2002 | Bartlett et al. | 5/713 X |

FOREIGN PATENT DOCUMENTS

| | | | | | |
|---|---|---|---|---|---|
| CH | 262519 | A | * | 10/1949 | 5/710 |

* cited by examiner

*Primary Examiner*—Robert G. Santos
(74) *Attorney, Agent, or Firm*—Bachman & LaPointe, P.C.

(57) ABSTRACT

A mattress is provided with a plurality of inflatable cushion elements each having two cushion chambers. Air or filling pressure medium can be regulated by a device with a pump. The pump is coupled to a control in which filling pressure values and/or arithmetical operations are programmed. The pump is also provided with sensors. This enables the filling pressure to be increased or reduced on the basis of the weight of a lying person loading the cushion elements until a predetermined value corresponding to a specific degree of hardness or comfort for lying is attained. Simple pressure on a key on a remote control is therefore sufficient to bring about completely automatic adaptation to the lying person, regardless of whether he or she weighs 40 or 150 kg. This intelligent mattress offers an absolute maximum of individual comfort for lying with a minimum of effort for operation.

8 Claims, 2 Drawing Sheets

MATTRESSES OR CUSHIONS

FIELD OF THE INVENTION

The present invention relates to a mattress or cushion with at least one cushion element which can be inflated or filled with a pumpable filling medium or with a cushion chamber.

BACKGROUND OF THE INVENTION

In known air cushion mattresses, cushion elements or air chambers which are mutually spaced in parallel transversely to the length of the mattress can be inflated individually. The air chambers are embedded in filling and supporting material and are preferably covered with several layers of wool and silk. Inflation nozzles of the cushion elements are advantageously arranged on the side of the mattress body in such a way that they are readily accessible but still protected and do not cause problems. The Applicant developed a mattress of this type in 1983. Inflation is usually effected using an air pump which can be applied in each case to the desired cushion element. Each cushion element can be inflated to the desired hardness by this hand pump. However, as this is awkward, the use of an electric pump has been proposed. Although it is easier to operate than a hand pump, it still appears too complicated to many customers. Therefore, the possibilities of an air cushion mattress are rarely utilised correctly in practice. A further drawback lies in the configuration of the cushion elements or the air chambers. Broad pillow-like cushion elements are required for obtaining a comfortable lying surface. However, this reduces the breathing activity of the mattress as the circulation of air is obstructed. A mattress which prevents the circulation of air causes the sleeping person to perspire to a considerably greater extent. The moisture precipitates and can in turn cause the formation of unhealthy fungus. However, the narrow air chambers in the form of air tubes intended to prevent this problem form unpleasant pressure points on the lying surface. The attainment of optimum lying comfort for an individual by pumping and letting out air is so awkward in each case that air cushion mattresses could not formerly gain acceptance on the market.

SUMMARY OF THE INVENTION

It is the object of the invention to provide a mattress or a cushion which is superior to formerly known mattresses or cushions with respect to comfort, ergonomy and handling.

According to the invention, there is provided a mattress having at least one cushion element which is adapted to be inflated with a pumpable filling medium and a device for regulating the pressure of said filling medium in said cushion element, said device being equipped with a control in which at least one of filling pressure values and at least one arithmetical operation for determining a filling pressure value are predetermined or programmed.

Preferably, a plurality of inflatable cushion elements are provided, each cushion element comprising a plurality of cushion chambers which are connected to one another by means of a connecting chamber.

The device for regulating the pressure is preferably connected via at least one line to the cushion elements, each line being guided via its own valve to a pump.

Desirably, the device for regulating the pressure is designed in such a way that the filling pressure can be controlled until a predetermined value corresponding to a specific degree of hardness or comfort for lying is attained, on the basis of the weight of a lying person loading the inflatable cushion elements.

Further, the device for regulating the pressure may be coupled to a sensor for determining the pressure activated by the weight of a. lying person and may also be designed in such a way that pressure adaptation takes place separately in each cushion element.

According to a preferred embodiment of the invention, the device for regulating the pressure is designed in such a way that the pressure adaptation takes place firstly as a function of the weight of a lying person and secondly as a function of an adjustable degree of hardness or comfort for lying, for example in the stages "hard", "medium" or "soft".

The or each cushion element desirably has a wall which is turned toward the lying surface and which is designed in such a way that it remains substantially flat when inflated.

Preferably, the or each cushion element has an approximately rectangular crosssection when inflated, said cushion element being composed of corresponding wall parts consisting of a soft but only slightly elastic material.

According to a further embodiment of the invention, a remote control device is provided on which the contours of a person are mapped with the purpose of enabling an operator to adapt the position of the said at least one cushion element with control keys.

BRIEF DESCRIPTION OF THE DRAWINGS

A preferred embodiment of the subject of the invention is described in more detail hereinafter with reference to the drawings, in which.

DESCRIPTION OF PREFERRED EMBODIMENT

Figure 1:
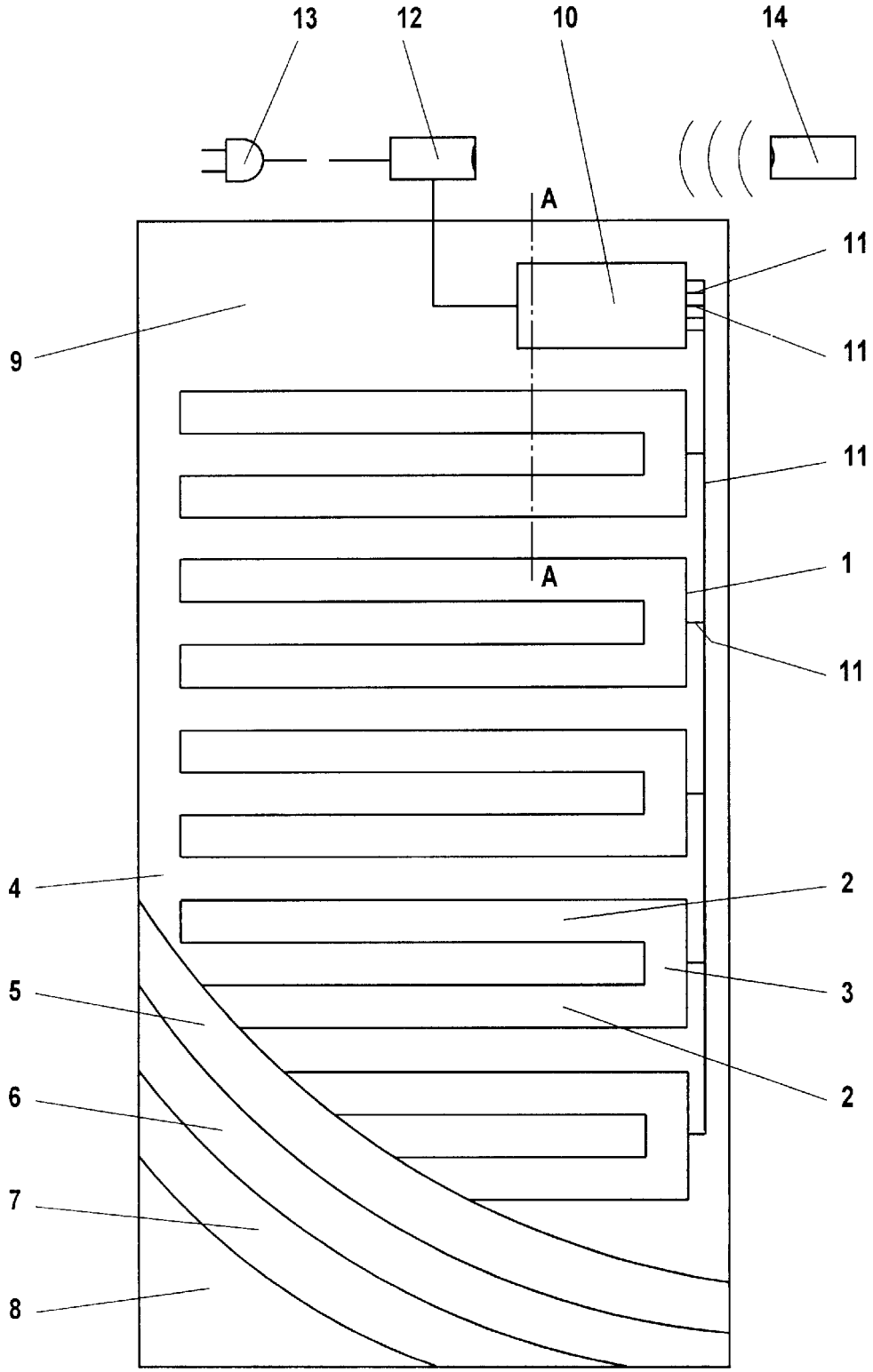
FIG. 1 is a schematic view of one embodiment of a mattress according to the present invention.

Reference will first be made to FIG. 1 of the drawings in which a plurality of cushion elements 1 are arranged in the body of a mattress. The cushion elements 1 have a U-shaped configuration, forming two respective air or cushion chambers 2 which are connected to one another by a lateral connecting chamber 3 and can be inflated together. The cushion elements 1 of which there are 5 in the present example are embedded in a high-grade elastic foam 4. The mattress body made up in this way is surrounded by a protective sheath 5 to which a layer of shorn wool 6 and a layer of tussah-silk 7 are applied. As normal, the assembly is surrounded by a cover 8.

A device 10 for regulating the air or filling pressure in the mattress body is arranged in the region of the head or foot end 9 where cushion chambers 2 are not required anyway. It is connected to the inflatable cushion elements 1 by lines 11, a separate individual line 11 leading to each cushion element 1. The device 10 is connected to a power supply unit 12 via a current lead. The power supply unit serves, on the one hand, as a transformer for transforming the line current 13 into light current, preferably 24 volt, and, on the other hand, as a receiver for a remote control 14. The remote control 14 is preferably cordless. The transformer is also coupled to a safety isolating device which interrupts the power supply to the device 10 for regulating the air or filling pressure when it does not have to be in operation, i.e. once the desired adjustments have been made.

Figure 2:
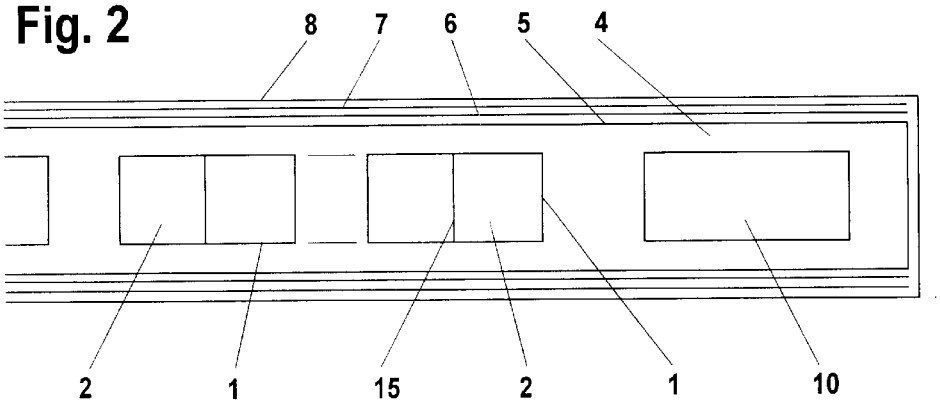
FIG. 2 is a section taken along the line A—A in FIG. 1.

According to FIG. 2, the cushion elements 1 are so designed that the two cushion chambers 2 are wider than they are high, for example 14 cm wide and 7 cm high. A web 15 which divides the cushion chamber 2 into two halves is arranged in the longitudinal direction of each cushion chamber 2. The web 15 alone cannot adequately prevent the cushion chamber 2 from being inflated to a taut round cross-section. Two halves are formed by the web 15 so the cushion chamber 2 would be inflated in the form of an 8 in cross-section. For this reason the cushion elements 1 are additionally designed in such a way that they retain an approximately rectangular shape even when inflated. This can be achieved, for example, in that the cushion chambers 2 are made up of appropriately assembled individual wall parts. Preferably the wall parts are soft but only expandable to a limited extent so that they do not pose a problem once lightly inflated and only curve slightly when inflated more vigorously. It is important that the wall of the cushion chamber 2 located toward the lying surface in each case remains as flat as possible. An approximately flat lying surface which corresponds roughly to that of a lath grid is produced in this way. Particularly with rigidly inflated roundish tubes of the formerly conventional type, on the other hand, a less comfortable lying surface would be obtained with perceptible ribs which form unpleasant pressure points and prevent restful sleep so that firmer inflation has not been possible in practice hitherto. According to the invention, however, both the lying comfort and the versatility of the mattress are substantially improved by the approximately flat lying surface.

Figure 3:
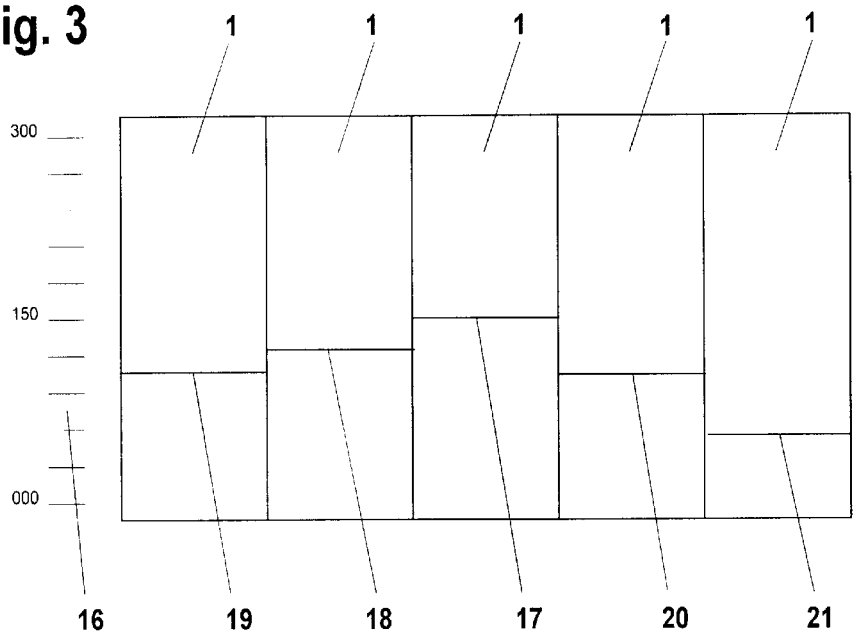
FIG. 3 shows a pressure distribution diagram.

The device 10 for regulating the air and filling pressure, which preferably comprises a diaphragm vacuum pump is designed in such a way that each individual line 11 can be loaded with its own pressure. For this purpose, the pump comprises five different valves. A mattress with a smaller or larger number of separately inflatable cushion elements 1 is obviously also conceivable. The device 10 is provided with a programmable control by means of which the cushion elements 1 can be regulated individually according to the values specified by the manufacturer and/or according to the individual wishes of the user. FIG. 3 shows an example of a pressure distribution diagram. It is divided into five regions corresponding to the number of cushion elements 1. The individual cushion elements 1 can be inflated according to a pressure scale 16 which extends to 300 millibar here. It is expedient to select the highest pressure in the buttocks region 17 whereas the other regions are graduated accordingly. The lowest pressure is required in the leg region 21.

The control or the programme of the device 10 for regulating the filling pressure should preferably be so designed that the user can adjust the desired hardness in the adjustment region between a predetermined minimum and a maximum pressure. This ensures that the cushion chambers 2 cannot be damaged. Furthermore, at least one basic setting is predetermined for the control. It is assumed that the user is of an average weight. To allow people of any weight to lie comfortably, the device 10 and its control are so designed that completely automatic individual weight adaptation takes place on request. Owing to the weight of the person lying on the mattress or on the inflated cushion elements 1, a specific, individually varying pressure which is detected by electronic sensors loads the valves of the device 10. If the user now gives the command for weight adaptation by means of simple key pressure, the control actuates the pump as well as the individual valves completely automatically so the pressure in the cushion chambers 2 of the individual cushion elements 1 is adapted to the weight loading it until the comfort for lying corresponding to the basic setting is achieved. For this purpose, the control programme can be so designed that each lying pressure activates a specific pump pressure either via predetermined stored values or via a predetermined arithmetical operation. For a heavy person, the cushion elements 1 are inflated to a correspondingly high pressure. For a light person, on the other hand, the air is let out of the cushion elements 1 until the predetermined values are attained. In both cases, this can take place separately for each cushion element 1 so the individually varying size and the physique can ultimately also be allowed for. As mentioned, either one or also more basic settings can be predetermined as starting position so various, individually adapted stages of hardness or comfort for lying can be called up. For example, the three stages "hard", "medium" and "soft" could be predetermined, adaptation to the individual weight taking place automatically or by key control. The necessary data and operations are programmed in the control. Therefore it is completely immaterial whether a child or a person weighing 150 kg lies on the mattress. Anyone can adjust their mattress individually by pressing a single key. Adaptation to individual wishes is obviously also possible without further ado. If the mattress is too soft or too hard for the user, or if more supporting force or comfort is desired in certain regions, the zones can be reset manually. For example, the cushion element 1 in the buttocks or shoulder region 17 or 19 can have somewhat more pressure applied or removed as desired. For this purpose also it is merely necessary to press a key. The values are then stored. If another person sleeps in this bed, he or she presses the control key 32 again.

Figure 4:
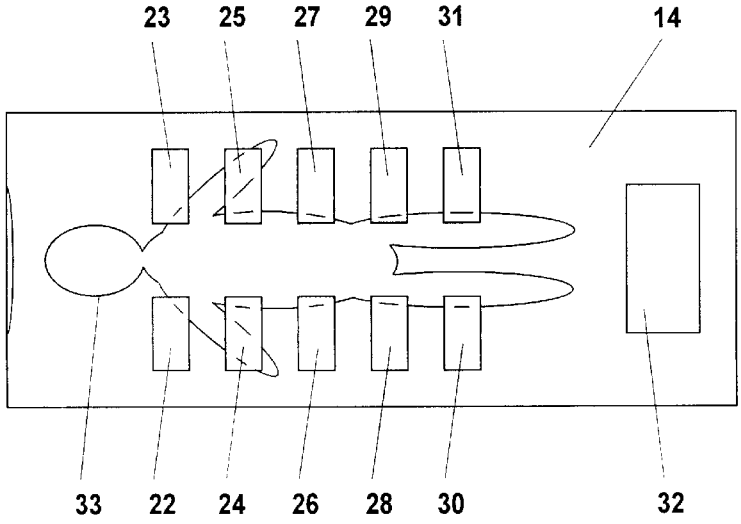
FIG. 4 shows a remote control.

According to FIG. 4, the remote control 14 is provided with control keys 22 to 32. To give the user a better overview, the contours 33 of a person are preferably mapped on the remote control so the position of the cushion elements 1 associated with the control keys can be seen immediately. The corresponding cushion element 1 can be made softer by the control keys 22, 24, 26, 28 and 30 and harder by the control keys 23, 25, 27, 29 and 31. The control key 32 can be pressed here for individual, completely automatic adaptation. However, it is also possible to design this control key 32 as a protected key to prevent unintentional adjustment. For this purpose, the key could be arranged under a flap or behind a slider, for example also on the back of the remote control 14. It is also conceivable to design the control key 32 to be actuable only with a tool, for example with the tip of a ball-point pen. Furthermore, a plurality of keys associated with different degrees of hardness can also be provided. It would also be possible to provide a plurality of control keys 32 designed as storage keys so a plurality of people can call up their stored individual setting by pressing their personal key. This could be useful, inter alia, in guest rooms or holiday apartments. It is pointed out in this connection that this mattress is also eminently suitable, in particular, for high-class hotels as they allow the desired comfort for lying to be offered to each guest as a special service. As it is only necessary to press a single key for this purpose, this does not pose any problems either for the guest or for the staff.

In the scope of the invention, the mattress or the cushion can also be designed differently from that described hereinbefore. Theoretically, a filling medium other than air could also be used, providing that this medium is pumpable. It is also possible to provide one or more pressure-compensating chambers, the cushion chambers 1 being regulated by pumping the medium to and fro between them and the pressure-compensating chambers. It will be appreciated that the proposed air pump system is simplest. In each case, the customer is offered an intelligent mattress which offers an absolute maximum of individual comfort for lying with a minimum of effort for operation.

The invention is not restricted to the above-described embodiment but variations and modifications may be made without departing from the spirit and scope of the invention as defined by the appended claims. In this connection, it should be noted that the term "mattress" where used in the claims is intended also to embrace cushions.

I claim:

1. A mattress having a plurality of cushion elements each of which is adapted to be inflated with a pumpable filling medium and a device for regulating the pressure of said filling medium in each of said cushion elements, said device being equipped with a control in which at least one of filling pressure values and at least one arithmetical operation for determining a filling pressure value are predetermined or programmed; in which the device for regulating the pressure is designed in such a way that pressure adaptation takes place separately in each cushion element so that each cushion element is loaded with its own uniform desired pressure and in such a way that the pressure adaptation takes place firstly as a function of the weight of a lying person and secondly as a function of an adjustable degree of hardness or comfort for lying.

2. A mattress as claimed in claim 1, wherein each cushion element comprises a plurality of cushion chambers which are connected to one another by means of a connecting chamber.

3. A mattress as claimed in claim 2, wherein the device for regulating the pressure is connected via at least one line to the cushion elements, each line being guided via its own valve to a pump.

4. A mattress as claimed in claim 1, wherein the device for regulating the pressure is designed in such a way that the filling pressure can be controlled until a predetermined value corresponding to a specific degree of hardness or comfort for lying is attained, on the basis of the weight of a lying person loading the cushion elements.

5. A mattress as claimed in claim 4, wherein the device for regulating the pressure is coupled to a sensor for determining the pressure activated by the weight of a lying person.

6. A mattress as claimed in claim 1, wherein each of said cushion elements has a wall turned toward the lying surface which is designed in such a way that it remains substantially flat when inflated.

7. A mattress as claimed in claim 6, wherein each of said cushion elements has an approximately rectangular cross-section when inflated, said cushion element being composed of corresponding wall parts consisting of a soft but only slightly elastic material.

8. A mattress as claimed in claim 1, wherein a remote control device is provided on which the contours of a person are mapped with the purpose of enabling an operator to adapt the position of the said cushion elements with control keys.

* * * * *